US006374423B1

(12) United States Patent
Anderson et al.

(10) Patent No.: US 6,374,423 B1
(45) Date of Patent: Apr. 23, 2002

(54) SPORTS HELMET WITH FULL FLEXIBLE BRIM

(75) Inventors: Kris A. Anderson; Gayle D. Anderson, both of 1239 Buck Is. Dr., Klamath Falls, OR (US) 97601

(73) Assignees: Kris A. Anderson; Gayle D. Anderson, both of Klamath Falls, OR (US)

( * ) Notice: Subject to any disclaimer, the term of this patent is extended or adjusted under 35 U.S.C. 154(b) by 0 days.

(21) Appl. No.: 09/859,621

(22) Filed: May 18, 2001

(51) Int. Cl.[7] ..... A63B 71/10; A61F 9/00

(52) U.S. Cl. ..... 2/425; 2/12; 2/68; 2/175.6; 2/209.12; 2/422

(58) Field of Search ..... 2/425, 422, 12, 2/10, 209.12, 209.7, 195.7, 175.6, 68, 411, 410

(56) References Cited

U.S. PATENT DOCUMENTS 5,519,895 A 5/1996 Barnes, Jr. ..... 2/422
5,727,250 A 3/1998 Black ..... 2/10
5,896,587 A 4/1999 Gentry ..... 2/425

*Primary Examiner*—Rodney M. Lindsey

(57) ABSTRACT

A sports helmet with a full fabric brim. The helmet protects the skull from impact while the brim provides sun protection to the face, ears, neck, and upper shoulders. The helmet consists of a bowl-shaped, thin-walled, protective shell. The shell contains tear shaped vent holes in the crown and circular vent holes in the front and rear. The shell padding consists of closed cell foam pads in the front, rear, and crown. The helmet is secured by a four-point strap and is closed with a plastic snap buckle. A full fabric brim is attached to the inner edge of the shell with hook and loop strips. The shell padding is secured to the inner lining of the brim band with hook and loop strips. The brim band sandwiched between the shell and the padding provides a very secure attachment. The brim is constructed of heavy duty fabric that is pliable yet maintains its shape in extreme conditions. The material actually stiffens slightly when wet, making it ideal for water sports. The brim will give upon impact so a blow is distributed evenly across the surface of the shell.

4 Claims, 5 Drawing Sheets

SPORTS HELMET WITH FULL FLEXIBLE BRIM

BACKROUND

1. Field of Invention

This invention relates to sports helmets, specifically to a sports helmet with a full flexible brim to be used for outdoor sports where protection from the elements is desired.

BACKROUND

2. Description of the Prior Art

Presently sports helmets provide protection against impact to the head but do not provide adequate protection against sun exposure nor are they designed to meet the unique demands of use in water sports. Many of today's recreational sports are practiced for long hours in intense sunlight. A few of the current sports helmets are produced with. small rigid visors or transparent sun shields. An example is the bicycle helmet in U.S. Pat. No. 5,896,586 to Gentry (1999). While this helmet gives some degree of protection to the medial facial area, it does not provide adequate sun protection to the lateral or anterior areas of the face, ears, or neck. U.S. Pat. No. 5,519,895 to Barnes (1996) provides a cap cover over a helmet, attempting to hide the fact that the user has a helmet on. The elastic band attaching the cap to the helmet would not be functional in windy conditions nor with use in water sports. In addition, the fact that the cap fits over the helmet gives the head a large appearance. The hard non-flexible disc in U.S. Pat. No. 5,727,250 to Black (1998) provides sun protection but would not be functional as a sports helmet. A lateral blow to such a structure would likely cause displacement of the helmet and possibly cause injury to the user.

SUMMARY

The object of the invention is to provide a water sports helmet which combines the head protection of a helmet with the sun protection of a full brimmed hat. A full cloth detachable brim is affixed between a thin-shelled protective helmet and the helmet's inner padding. The preferred method of attachment would be hook and loop strips. The protective shell is held securely in place by a four-point chin strap. Another object is to provide a brim that is pliable yet holds its shape when used in water and/or wind, such as wind surfing, jet skiing, etc . . .

OBJECTS AND ADVANTAGES

Accordingly, this protective shell with detachable full brim has two distinct advantages: It protects the head of the user from impact and it provides maximum solar protection to the face and neck area. Unlike a helmet with a hard brim, the fabric brim will give on impact so that a lateral blow does not displace the helmet. Impact from such a blow will be evenly distributed throughout the helmet shell. Furthermore, many hat brims lose their shape when used in wind or water, thus becoming a nuisance. This brim stiffens when wet therefore holding its shape. The shell is held securely to the user's head by means of a four-point chin strap. Additionally, shell and detachable brim come in a variety of colors, which may be mixed, and matched to achieve any desired appearance. If preferred, the shell may be worn singularly without the brim. Further objects and advantages of this invention will become apparent with a consideration of the drawings and ensuing description.

REFERENCE NUMERALS IN DRAWINGS

| | |
|---|---|
| 10 | protective shell |
| 12 | tear shaped vent holes |
| 14 | circular vent holes |
| 16 | brim snap (male) |
| 18 | brim snap (female) |
| 20 | fabric brim |
| 22 | strap rivet |
| 24 | nylon chin strap |
| 26 | plastic snap buckle |
| 30 | brim band |
| 32 | front pad |
| 34 | rear pad |
| 36 | crown pad |
| 38 | hook and loop strips |

DESCRIPTION MAIN EMBODIMENT

Figure 1:
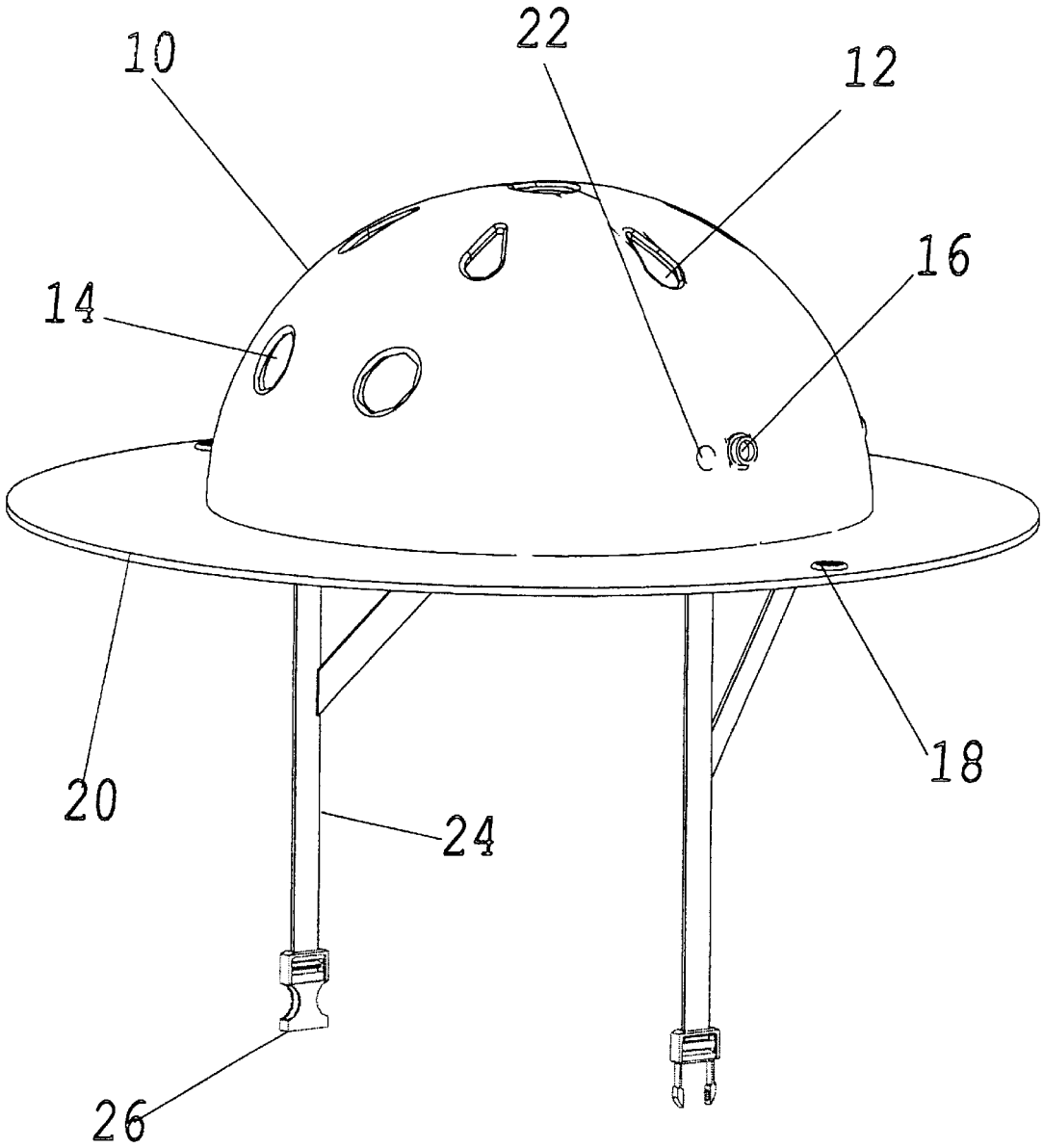
FIG. 1 shows a perspective view of this invention.
Figure 2:
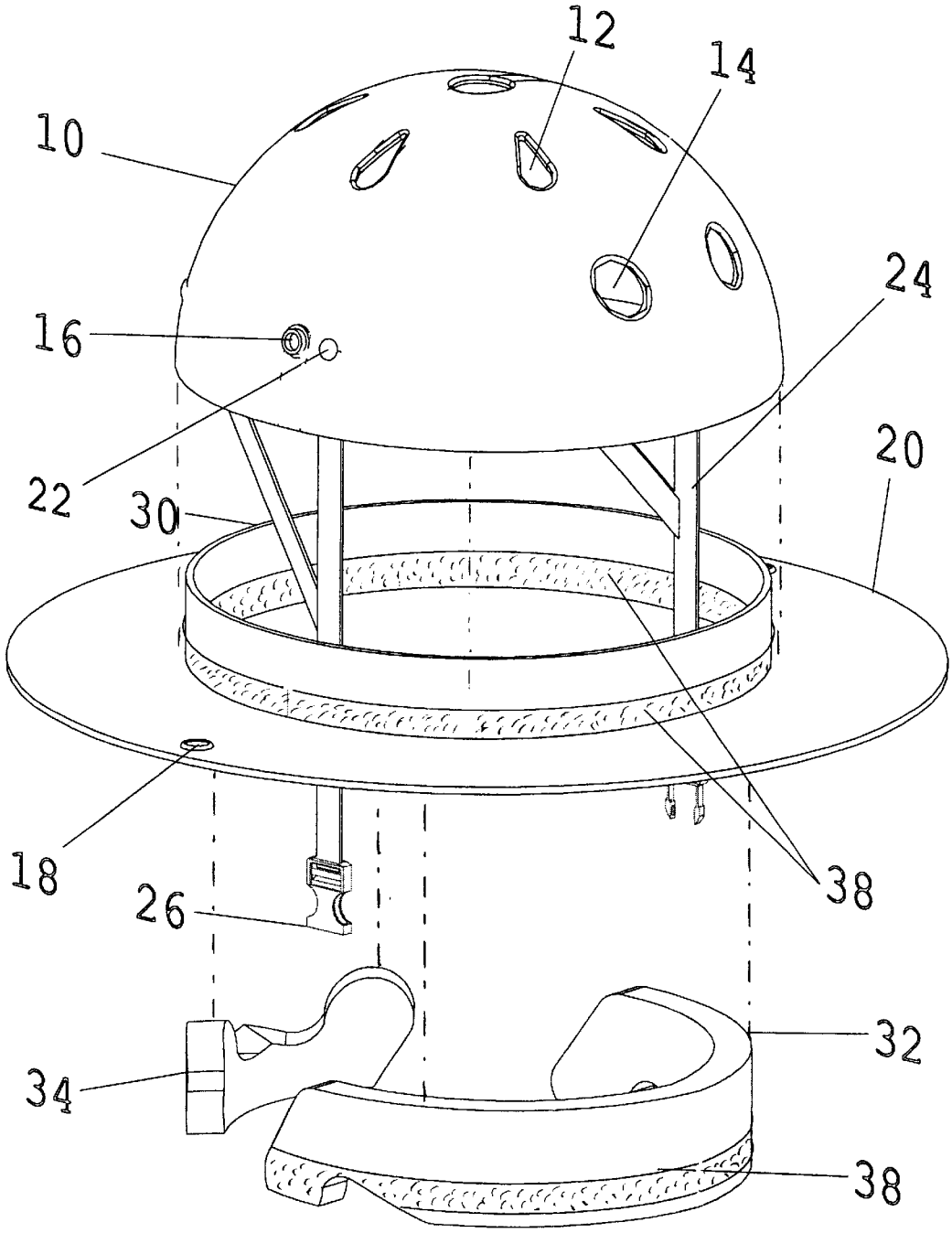
FIG. 2 shows a perspective exploded view of this invention.
Figure 3:
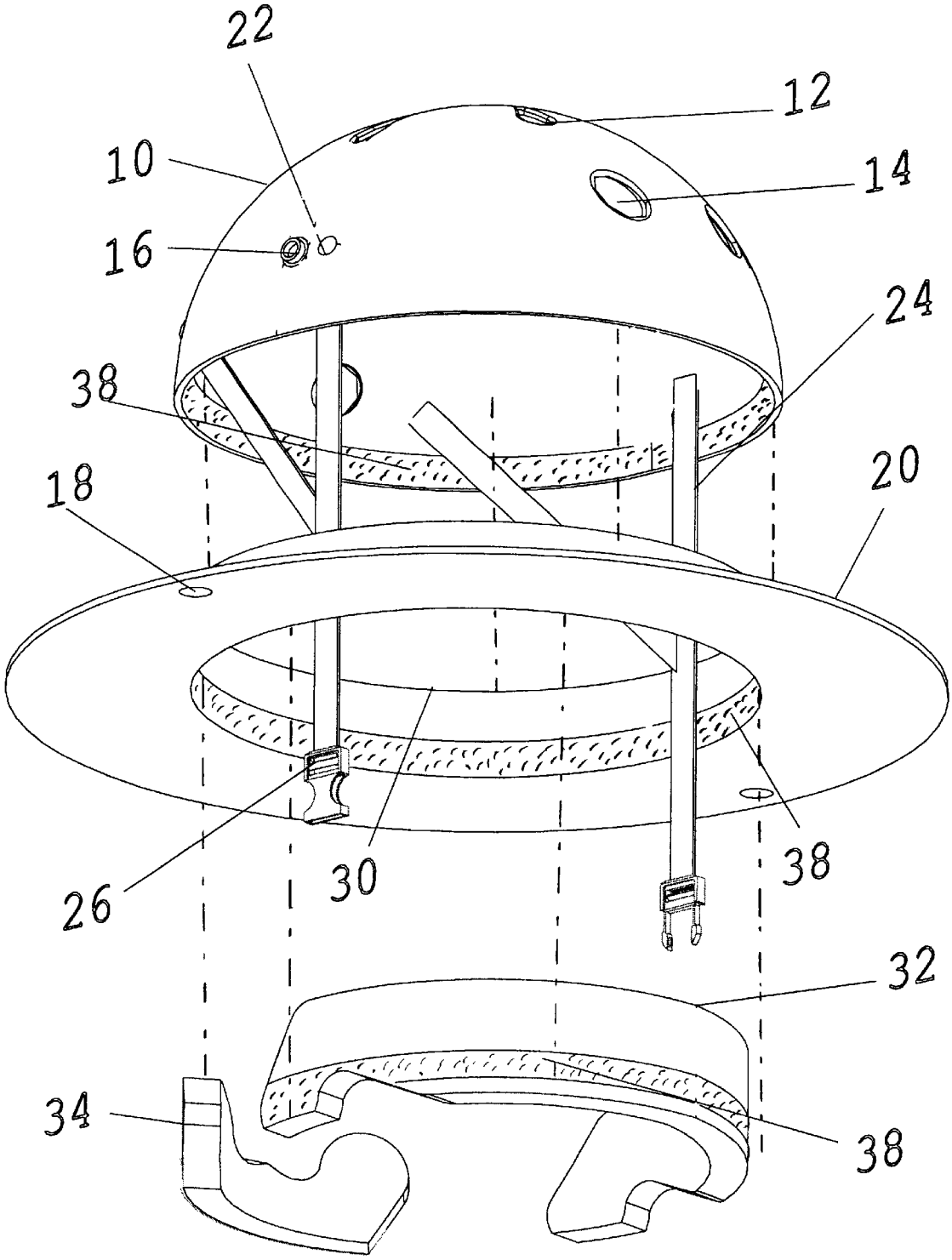
FIG. 3 shows a perspective exploded view (bottom) of this invention.
Figure 4:
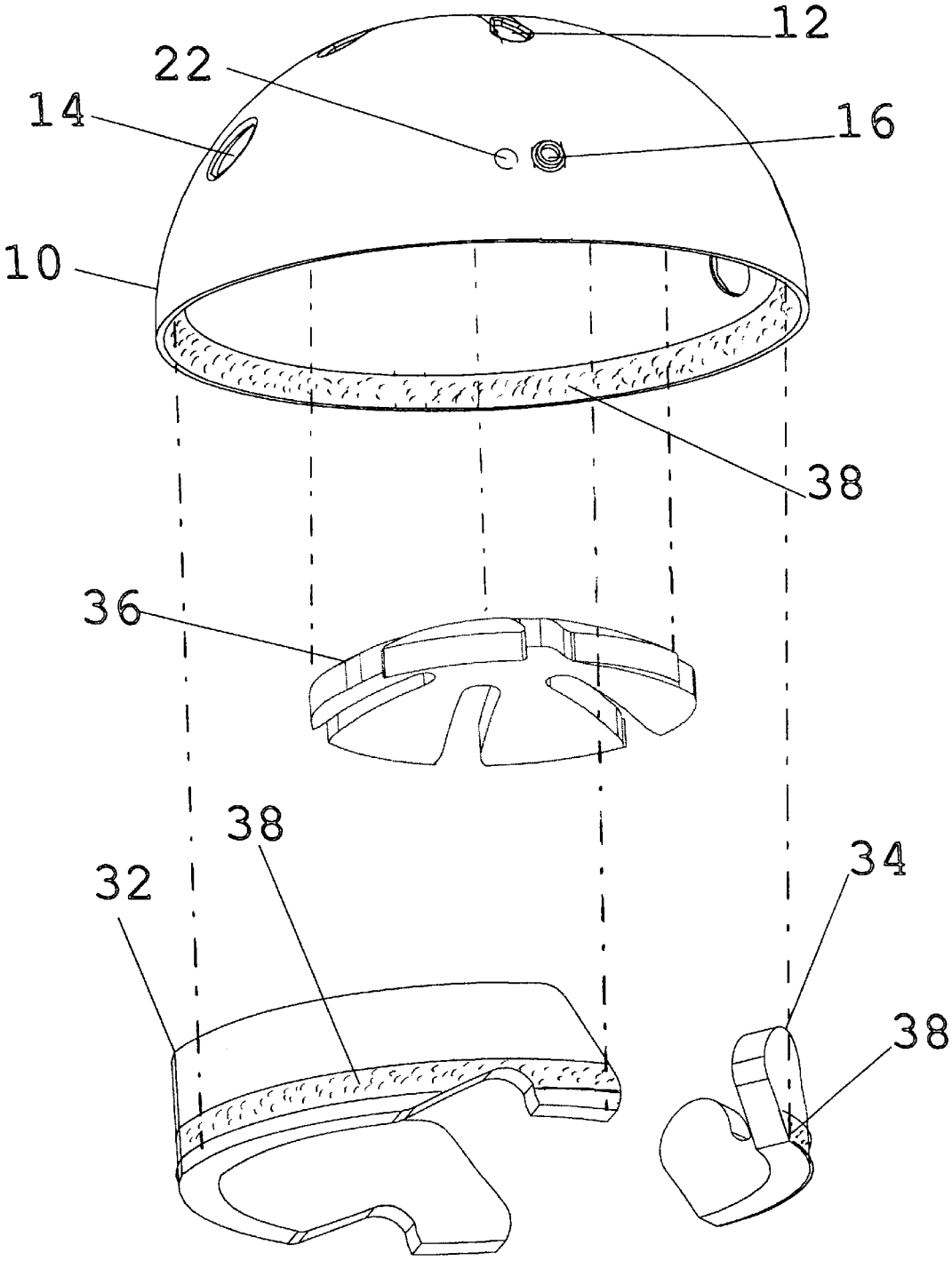
FIG. 4 shows a perspective exploded view in detail of the protective shell and padding elements of this invention.
Figure 5:
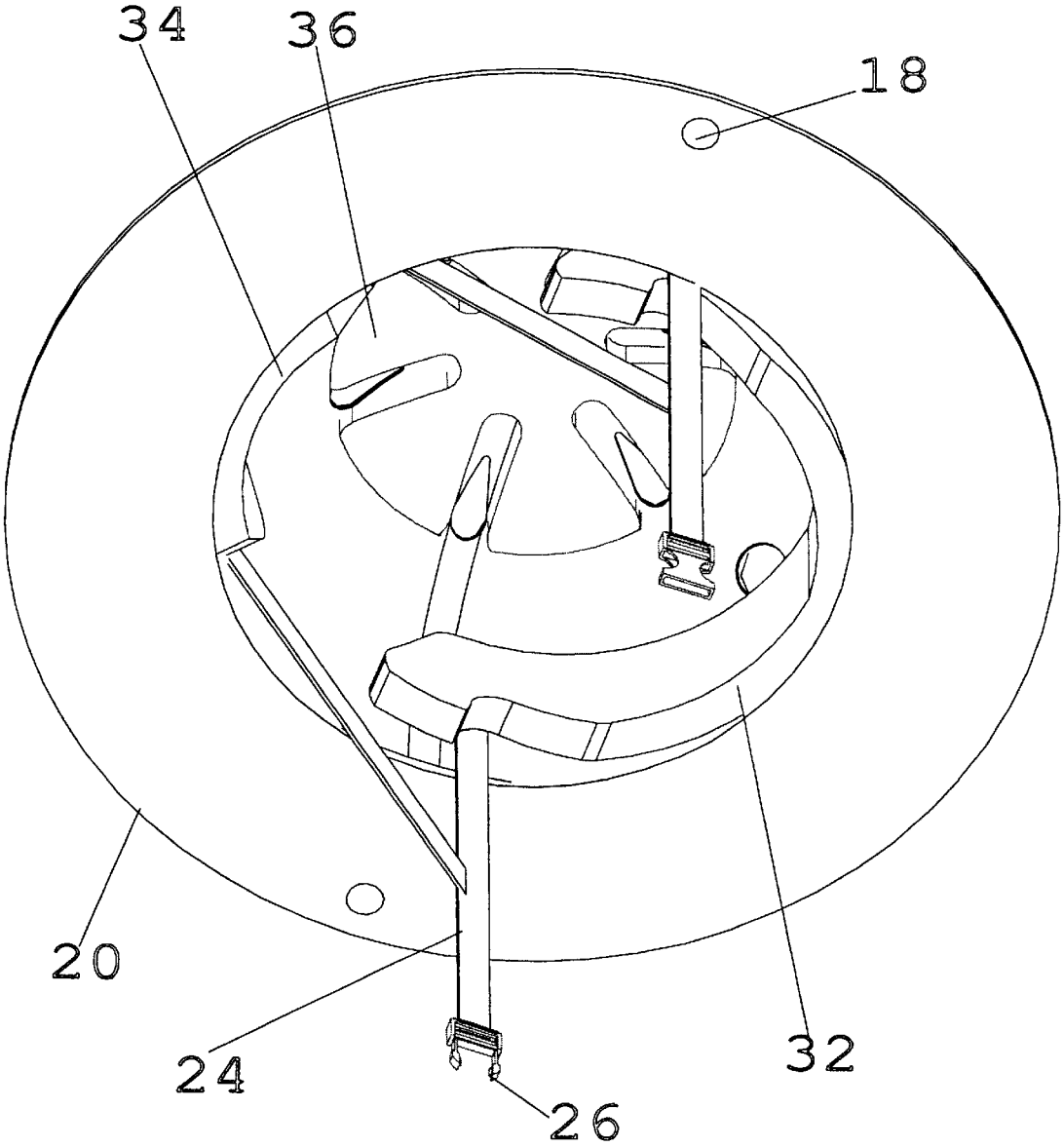
FIG. 5 shows a perspective (bottom) view of this invention.

As illustrated in FIGS. 1–5 the sports helmet with a full flexible brim is comprised of a protective shell 10 consisting of a lightweight thin walled plastic material. Shell 10 has six teardrop shaped vent holes 12 in the crown area and five circular vent holes 14 two in the front, two in the rear, and one centered on the top. A brim band 30 is sewn to the inner circumference of fabric brim 20 and is attached to the inner wall of protective shell 10 by hook and loop strips 38. A front pad 32 and a rear pad 34 consists of a closed cell foam material and are secured to the inner lining of brim band 30 by hook and loop strips 38. A crown pad 36 is secured by adhesive to the inner wall of the top of protective shell 10. A nylon strap 24 anchored at four points on protective shell 10 with aluminum or stainless steel rivets 22 descends between brim band 30 and padding 32 and 34. Strap 24 is secured under the chin of the user with a plastic snap buckle 26. Fabric brim 20 consists of two layers of eighteen ounce canvas and one inner layer of iron-on interfacing. Brim 20 extends approximately two and one-half inches outwardly from the base of protective shell 10.

OPERATION OF MAIN EMBODIMENT

Shell 10 provides protection from impact to the user's head. Protective shell 10 is adequately ventilated through a plurality of vent holes 12 and 14. Strap 24 holds shell 10 securely to the user's head. Strap rivets 22 attach strap 24 to shell 10. The strap is closed with plastic snap buckle 26. Fabric brim 20 provides sun protection to the user's face, ears, neck, and upper shoulders. The fabric is pliable so as to give upon impact. This pliability allows the force of a blow to be distributed evenly across the surface of protective shell 10. Fabric is thick enough to hold its shape and actually becomes stiffer when wet, making it ideal for use in water sports. Brim band 30 is attached to the inner wall of protective shell 10 with hook and loop strips 38. Closed cell padding 32, 34, 36 provide a cushion between protective shell 10 and the user's head and helps distribute a force of the blow. The closed cell construction does not allow water to enter padding 32, 34, 36 thus making it ideal for use in water. A pair of brim snaps 16, 18 allow fabric brim 20 to be snapped to the side of shell 10 providing a different over all appearance.

CONCLUSION, RAMIFICATION AND SCOPE OF INVENTION

Accordingly, the invention—a protective helmet with a full fabric brim—can be used in a variety of sports, particularly water sports, and still maintain it's shape. The fabric brim actually stiffens slightly when wet which makes it particularly useful in wet, windy conditions, but is not limited to such. The pliable brim will give upon lateral impact so as not to cause the helmet to be dislodged or cause injury to the user. In addition, because it is one unit, the user need not wear a hat underneath a separate helmet. The detachability of the brim allows for the mixing and matching of colors. The helmet can also be worn without the brim. The brim provides sun protection to the full facial area as well as the ears, neck, and upper shoulders.

Although the description above contains many specifications, these should not be construed as limiting the scope of the invention but as merely providing illustrations of some of the presently preferred embodiments of the invention. For example, the brim can be constructed out of a variety of durable fabrics and can assume various shapes, such as a baseball cap style.

Therefore, the scope of the invention should be determined by the appended claims and their legal equivalents, rather than by the examples given.

We claim:

1. A sports helmet with a full flexible brim comprising:

(a) a protective shell covering substantially the top portion of the of the users head, (b) padding material affixed to the interior of said shell, (c) a chin strap, and (d) connection means for connecting said shell and said strap together, (e) a full circular, removable brim having a means of attachment to the inner edge of the lower periphery of said shell, whereby said brim provides sun protection to the face, ears, neck, and upper shoulder area.

2. The protective shell of claim 1 further including a plurality of ventilation holes distributed symmetrically across said shell.

3. Sports helmet according to claim 1, comprising said brim sited in claim 1 is comprised of fabrics of predetermined pliability, whereby said fabrics give upon impact, allowing a lateral blow to the head to be distributed across the surface of said shell.

4. The fabrics of claim 3 wherein said brim contains means for causing it to stiffen slightly when saturated with water.

* * * * *